US009296524B2

(12) United States Patent
Woloveck et al.

(10) Patent No.: US 9,296,524 B2
(45) Date of Patent: Mar. 29, 2016

(54) CHILD-RESISTANT CLOSURE MECHANISM AND PACKAGING

(71) Applicant: Hollister & Blacksmith, Inc., Denver, CO (US)

(72) Inventors: Trent Woloveck, Denver, CO (US); Joshua Paul Schoettle, Loveland, CO (US)

(73) Assignee: Hollister & Blacksmith, Inc., Denver, CO (US)

( * ) Notice: Subject to any disclaimer, the term of this patent is extended or adjusted under 35 U.S.C. 154(b) by 0 days.

(21) Appl. No.: 14/455,543

(22) Filed: Aug. 8, 2014

(65) Prior Publication Data

US 2016/0039576 A1 Feb. 11, 2016

(51) Int. Cl.

| | |
|---|---|
| ***B65D 33/16*** | (2006.01) |
| ***B65D 33/28*** | (2006.01) |
| ***B65D 30/00*** | (2006.01) |
| ***B65D 55/02*** | (2006.01) |

(52) U.S. Cl.

CPC ..... *B65D 33/28* (2013.01); *B65D 29/00* (2013.01); *B65D 55/02* (2013.01)

(58) Field of Classification Search

CPC ..... B65D 33/28; A45C 13/1046
USPC ..... 383/74; 24/115 G
See application file for complete search history.

(56) References Cited

U.S. PATENT DOCUMENTS

| | | | | | |
|---|---|---|---|---|---|
| 852,180 | A * | 4/1907 | Hoffman | A47C 21/022 | 24/115 H |
| 1,368,545 | A * | 2/1921 | Childers | B65D 63/14 | 24/30.5 R |
| 2,578,504 | A * | 12/1951 | Canter | B65D 77/185 | 292/308 |
| 2,832,116 | A * | 4/1958 | Clevett, Jr. | B65D 63/14 | 24/115 H |
| 4,112,551 | A * | 9/1978 | Sales | A45C 13/1046 | 24/136 B |
| 5,263,232 | A * | 11/1993 | Matoba | F16G 11/10 | 24/115 G |
| 5,365,641 | A * | 11/1994 | Watanabe | A45C 13/1046 | 24/115 G |
| 5,681,115 | A | 10/1997 | Diederich et al. | | |
| 6,398,410 | B1 * | 6/2002 | Guerra | D06F 95/006 | 383/117 |

FOREIGN PATENT DOCUMENTS

| | | | |
|---|---|---|---|
| GB | 2 162 888 | A * | 2/1986 |
| JP | 08317812 | A * | 12/1996 |

* cited by examiner

*Primary Examiner* — Jes F Pascua
(74) *Attorney, Agent, or Firm* — Woods Oviatt Gilman LLP; Ronald J. Kisicki, Esq.

(57) ABSTRACT

A child-resistant packaging comprises a packaging container having a mouth and a drawstring positioned along the mouth for selectively opening and closing the mouth. A first cord lock is adapted to receive first and second ends of the drawstring. Actuation of the first cord lock enables the first cord lock to slidably engage the drawstring. In one aspect of the invention, a second cord lock has first and second lobes. The first lobe is adapted to receive the first end of the drawstring while the second lobe is adapted to receive the second end of the drawstring. Simultaneous actuation of the first and second lobes enables the second cord lock to slidably engage the drawstring.

14 Claims, 5 Drawing Sheets

CHILD-RESISTANT CLOSURE MECHANISM AND PACKAGING

TECHNICAL FIELD

The present invention relates to a child-resistant closure mechanism; more particularly, to a child-resistant closure mechanism employing two drawstring cord lock devices; still more particularly to a child-resistant closure mechanism wherein a first cord lock device is a single barrel cord device and wherein a second cord lock device may be a double barrel cord lock configured as a unitary body.

BACKGROUND OF THE INVENTION

Hazardous, poisonous, toxic or otherwise dangerous materials are typically stored within "child-resistant packaging" so as to minimize the potential for accidental exposure to inquisitive children. For instance, one example of such materials are pharmaceutical drugs or other therapeutic agents. As is known in the art, such materials are generally stored within rigid plastic containers having specially configured caps. To open the container, some advanced degree of manual dexterity is required to properly overcome the cap's safety features to gain access to the pharmaceutical agents therein. Ideally, the degree of manual dexterity needed to open the container is sufficiently high enough to prevent children from defeating the safety mechanism while also being not so complex that an elderly individual cannot readily open the container to retrieve his or her medications. While there are numerous container/cap systems in use with rigid containers, there is lack of child-resistant closure mechanisms for non-rigid containers, such as pliable plastic or fabric bags.

One attempt to produce a child-resistant reclosable bag is disclosed in U.S. Pat. No. 5,681,115 to Diederich et al. ("the '115 patent"). As disclosed in the '115 patent, a flexible bag is equipped with a zipper operatively coupled to the opening of the bag made from sheets of resinous material. The zipper has a pull tab for actuating the zipper to open and close the bag opening. The bag has a releasable lock support with locking arms which are adapted to receive the pull tab when the bag is closed. The lock support prevents actuation of the zipper unless on individual manually pivots the locking arms so as to release the pull tab from the lock support. While manually pivoting the locking arms, the individual can then slide the pull tab and thereby actuate the zipper to open the bag.

While the '115 patent provides a child-resistant locking device for a flexible bag, this device has a number of drawbacks. One drawback of the device disclosed within the '115 patent is the requirement that the individual attempting to open the closure have sufficient manual dexterity in both hands. That is, both hands must operate simultaneously to open the bag—one hand has to pivot the locking arms with the other hand slides the zipper. This two-handed operation may be problematic, and potentially ultimately defeating, for individuals who may lack adequate strength and/or dexterity in one hand, such as an elderly individual suffering from arthritis or carpal tunnel syndrome or those suffering from a disability which limits use of the hands.

Thus, what is needed is a child-resistant locking mechanism which may be easily opened by an adult using only one hand while also resisting the efforts of inquisitive children.

SUMMARY OF THE INVENTION

In accordance with an aspect of the present invention, a child-resistant packaging comprises a packaging container having a mouth and a drawstring positioned along the mouth for selectively opening and closing the mouth. A first cord lock is configured to receive first and second ends of the drawstring. The first cord lock is positioned adjacent the packaging. A second cord lock may have first and second lobes and is positioned adjacent the first cord lock opposite the packaging. The first lobe is adapted to receive the first end of the drawstring and the second lobe is adapted to receive the second end of the drawstring. Actuation of the first cord lock enables the first cord lock to slidably engage the drawstring to selectively close the mouth. The mouth is child-resistant locked after simultaneous actuation of the first and second lobes to slidably translate the second cord lock so as to position the second cord lock immediately adjacent the first cord lock. The mouth is selectively opened only after: i) simultaneous actuation of the first and second lobes of the second cord lock so as to slidably translate the second cord lock away from the first cord lock and ii) actuation of the first cord lock to translate the first cord lock toward the second cord lock.

In accordance with a further aspect of the present invention, the first cord lock comprises a cord lock housing having a side wall and a bottom forming a recess therein. The housing has a first pair and a second pair of holes formed on the side wall, with the first pair of holes diametrically opposed from one another and the second pair of holes diametrically opposed from one another. The first pair of holes is adapted to receive the first end of the drawstring and the second pair of holes is adapted to receive the second end of the drawstring. A plunger member is slidably disposed within the cord lock housing and has transversely disposed first and second through-holes configured to align with a respective first pair and second pair of holes. A biasing member is positioned between the bottom of the cord lock housing and the plunger member wherein, when the plunger member is depressed, the biasing member is compressed so that the first and second through-holes coaxially align with their respective first pair and second pair of holes. This allows the drawstring to slide within the first cord lock. When the plunger member is released, the biasing member expands so as to misalign the first and second through-holes with their respective first pair and second pair of holes so as to lock the drawstring between the plunger member and the cord lock housing.

In accordance with another aspect of the present invention, the second cord lock comprises a cord lock housing having first and second lobes. Each lobe has a side wall and a bottom forming a recess therein and a pair of diametrically opposed holes formed on the side wall. The holes of the first lobe are adapted to receive the first end of the drawstring and the holes of the second lobe are adapted to receive the second end of the drawstring. A respective plunger member is slidably disposed within each of the lobes, with each plunger member having a transversely disposed through-hole configured to align with its respective pair of holes. A biasing member is positioned within each lobe between the bottom of the lobe and its respective plunger member. When the respective plunger member is depressed, its respective biasing member is compressed so that the through-hole coaxially aligns with its respective pair of holes so as to allow the drawstring to slide within its respective housing lobe. When the respective plunger member is released, its respective biasing member expands so as to misalign the through-hole with its respective pair of holes so as to lock the drawstring between the plunger member and its respective housing lobe.

In accordance with the present invention, the first and second lobes of the second cord lock may be oriented opposite one another so that the respective plungers slide in opposing directions. Simultaneous actuation of the first and second lobes enables the second cord lock to slidably engage the drawstring.

In accordance with a further aspect of the present invention, the first and second ends of the drawstring further include a respective knob wherein each knob is configured to be larger than a respective hole on the first and second lobes.

In accordance with another aspect of the present invention, a method of childproofing a package comprises a) pulling the drawstring so as to selectively close the package mouth; b) actuating a first cord lock to slidably translate the first cord lock on the drawstring until the first cord lock is immediately adjacent the package thereby securing the mouth in a substantially occluded position; and c) simultaneously actuating first and second lobes of a second cord lock to slidably translate the second cord lock on the drawstring until the second cord lock is immediately adjacent the first cord lock. The mouth is selectively opened only after: i) simultaneously actuating the first and second lobes of the second cord lock so as to slidably translate the second cord lock away from the first cord lock and ii) actuating the first cord lock to translate the first cord lock toward the second cord lock.

Numerous applications, some of which are exemplarily described below, may be implemented using the present invention.

BRIEF DESCRIPTION OF THE DRAWINGS

The present invention will now be described, by way of example, with reference to the accompanying drawings, in which.

Figure 1:
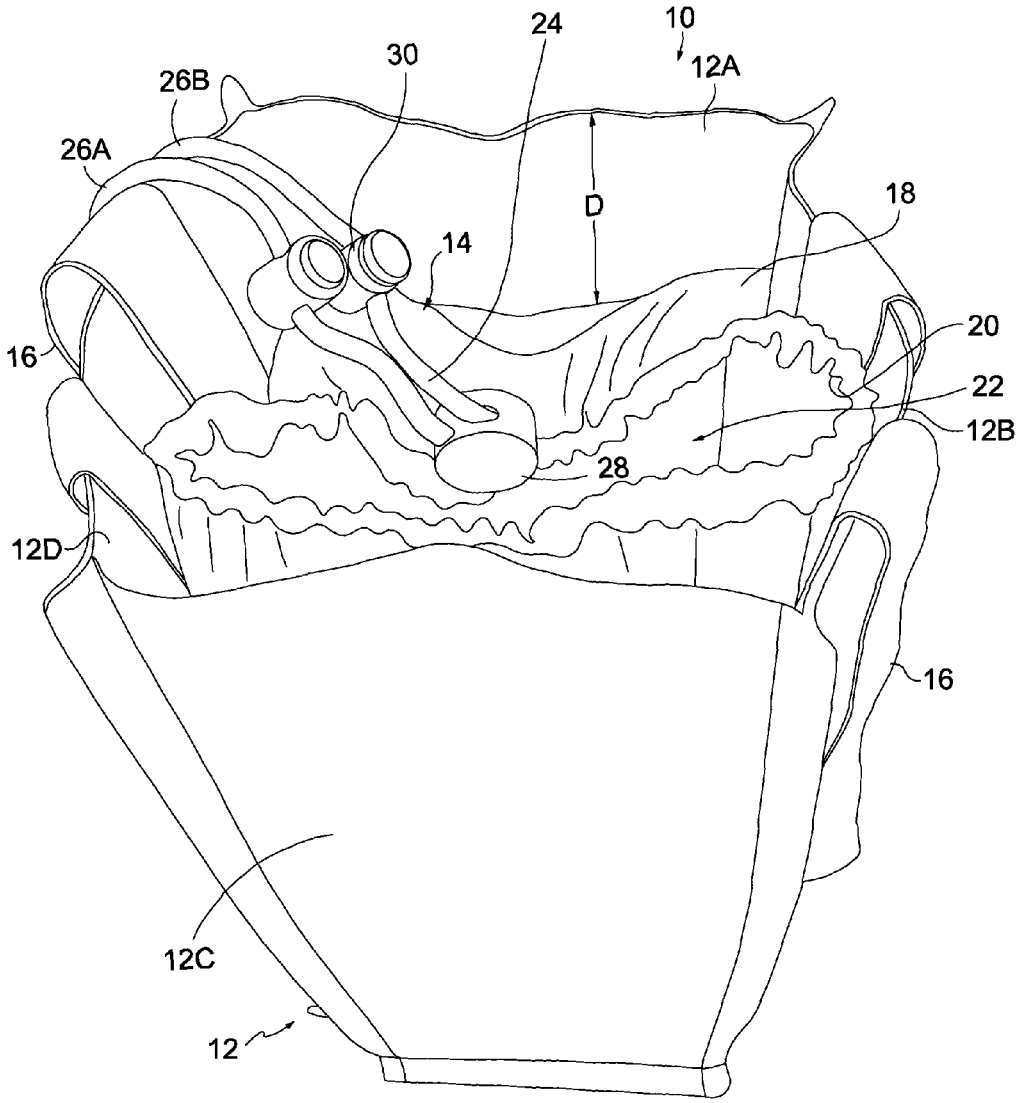
FIG. 1 is a top perspective view of an embodiment of a child-resistant packaging in accordance with the present invention with the packaging in an open configuration.

Corresponding reference characters indicate corresponding parts throughout the several views. The exemplifications set out herein illustrate currently preferred embodiments of the present invention, and such exemplifications are not to be construed as limiting the scope of the invention in any manner.

DESCRIPTION OF THE PREFERRED EMBODIMENTS

Figure 2:
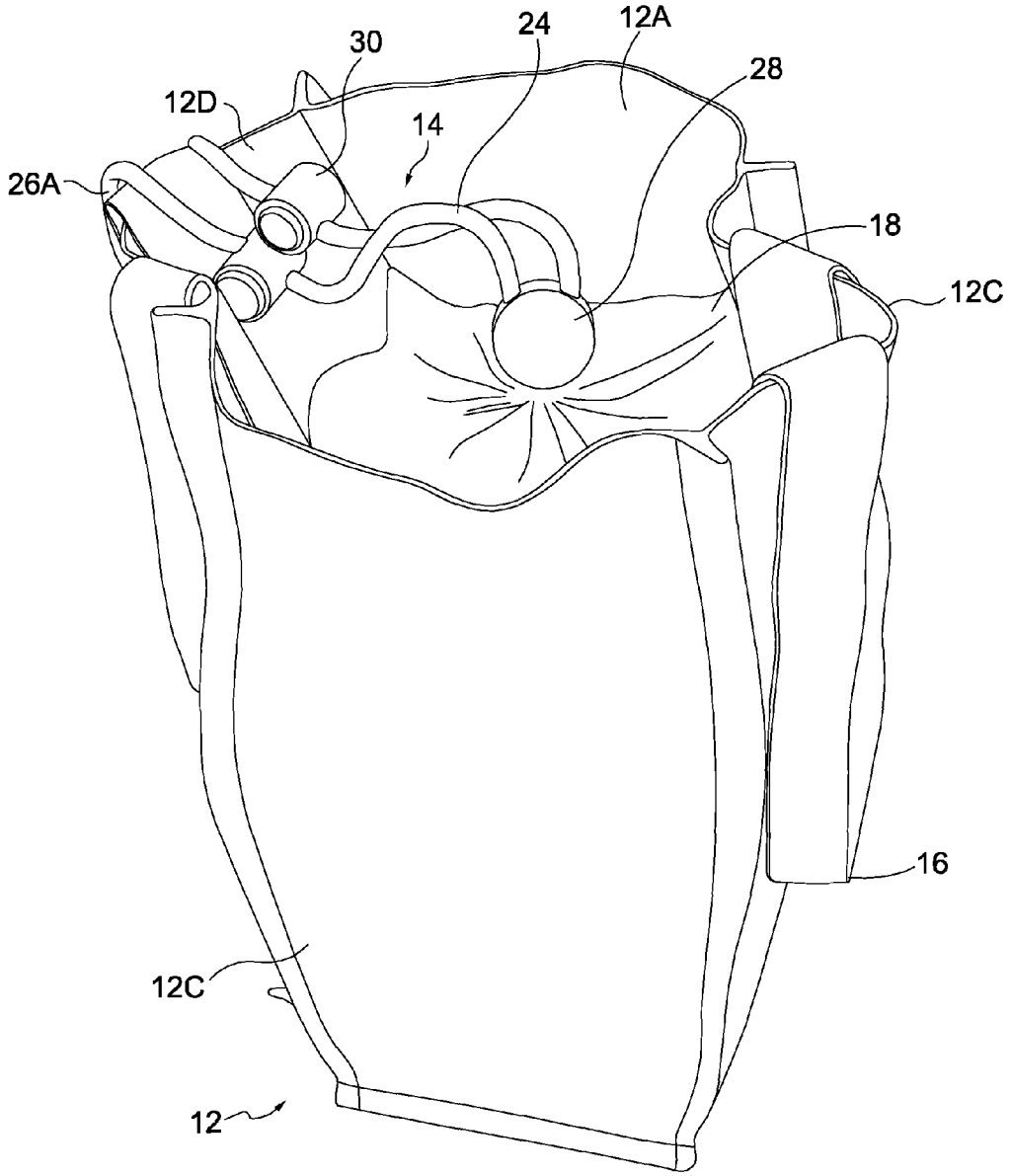
FIG. 2 is a top perspective view of the child-resistant packaging shown in FIG. 1 with the packaging drawstring closed and secured by a first cord lock.
Figure 3:
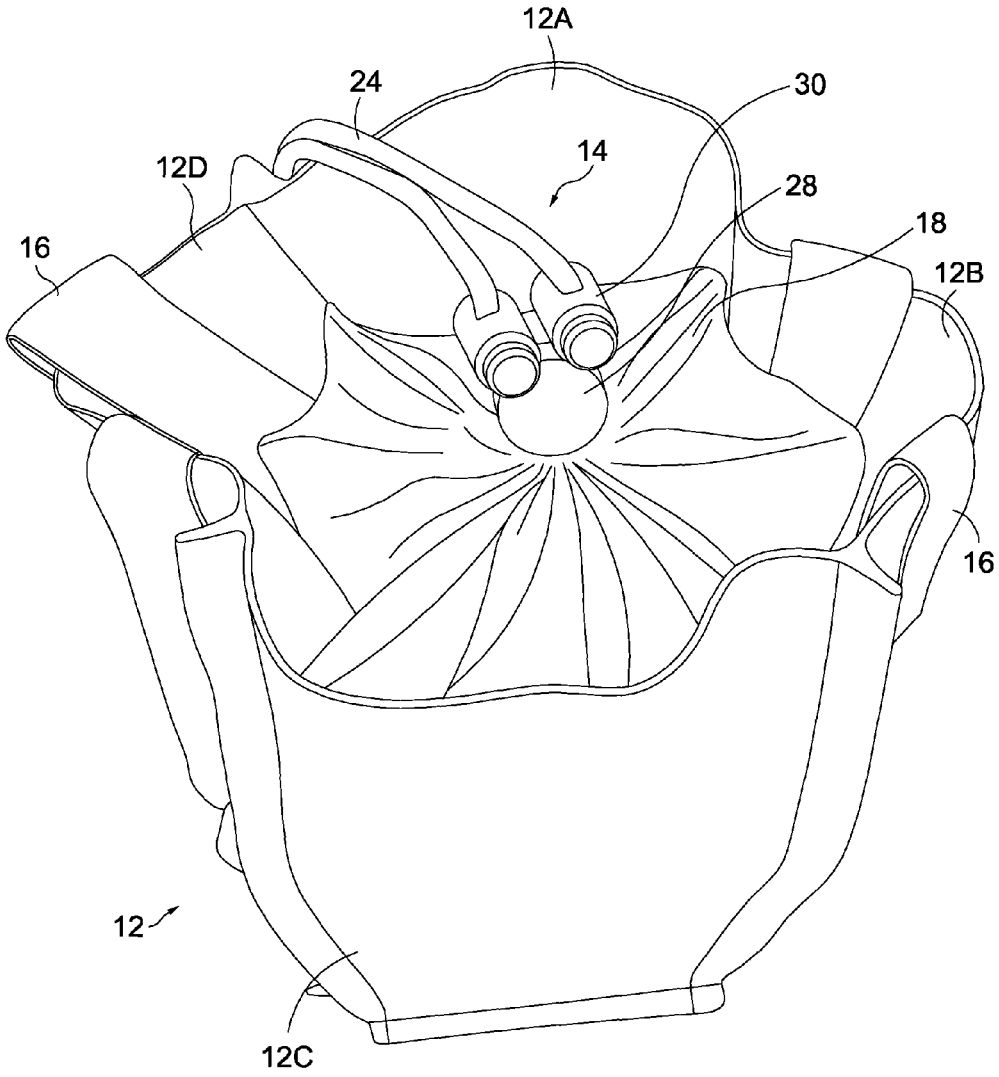
FIG. 3 is a top perspective view of the child-resistant packaging shown in FIGS. 1 and 2 with the packaging drawstring closed and secured by first and second cord locks.

Referring to FIGS. 1-3 an embodiment of a child-resistant packaging in accordance with the present invention is generally indicated by reference numeral 10. Child-resistant packaging 10 is generally comprised of a container, such as flexible bag 12, and associated closure mechanism 14 (see also FIG. 4). Flexible bag 12 may be constructed of any suitable material and should be puncture and tear resistant. Examples of suitable materials include, but are not limited thereto, woven or nonwoven synthetic fabric materials such as nylon, ultra-high molecular weight polyethylene (UHMWPE), aramid, polypropylene and polyester, non-synthetic fabric materials such as denim, silk and hemp, and combinations thereof. For instance, in accordance with an aspect of the present invention, flexible bag 12 may be manufactured using nonwoven polypropylene 80 GSM (grams per square meter). For convenient carrying, flexible bag 12 may also include one or more handles 16.

Flexible bag 12 may further include a top panel 18. Top panel 18 is configured to define a mouth 20 through which an individual can access interior cavity 22. A drawstring 24 is positioned along the length of the mouth to selectively open (FIG. 1) and close (FIGS. 2 and 3) mouth 20. Top panel 18 may be secured along the top edges of side panels 12A-12D of flexible bag 12 or may be secured to the bag an intermediate distance D from the top edges of side panels 12A-12D (as shown in FIG. 1). Top panel 18 (and drawstring 24) is proportioned such that, when in a closed configuration (FIGS. 2 and 3), drawstring 24 is drawn so as to constrict top panel 18 such that mouth 20 is substantially occluded, thereby preventing access to cavity 22. When in an open configuration (FIG. 1), drawstring 24 is loosened, thereby allowing top panel 18 to expand such that mouth 20 substantially coincides with the internal perimeter defined by side panels 12A-12D (i.e. minus only that amount of space occupied by drawstring 24 and its associated material of top panel 18). As a result, access to cavity 22 may be unencumbered by top panel 18 or drawstring 24.

As used herein, the phrase "substantially occluded" should be interpreted to mean that top panel 18 is drawn closed to such a degree that, at a minimum, whatever material is contained within flexible bag 12, little, if any, material would escape cavity 22 should flexible bag 12 be inverted.

In a further aspect of the present invention, distance D may be selected such that, when top panel 18 is in the fully open configuration, top panel 18 and drawstring 24 lie against the inner surface of side panels 12A-12D with drawstring 24 corresponding with the top edges of the side walls. Drawstring 24 is proportioned such that free ends 26A/26B are of sufficient length to carry first cord lock 28 and second cord lock 30 when top panel 18 is in the fully open configuration (see FIG. 1) while also being short enough so as not to impose an undue tangling hazard when top panel 18 is in the fully closed configuration (FIGS. 2 and 3).

Figure 4:
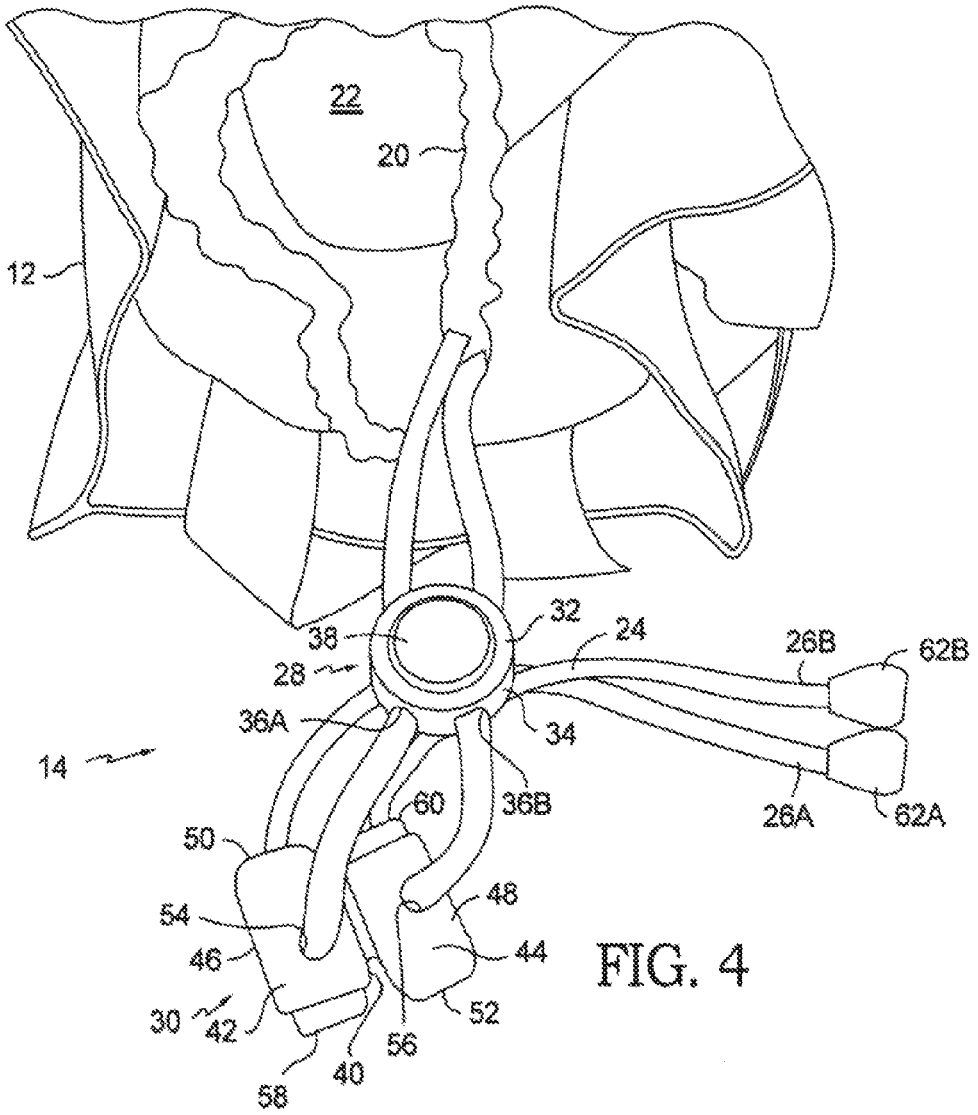
FIG. 4 is a detailed view of an embodiment of a child-resistant mechanism in accordance with the present invention.
Figure 5:
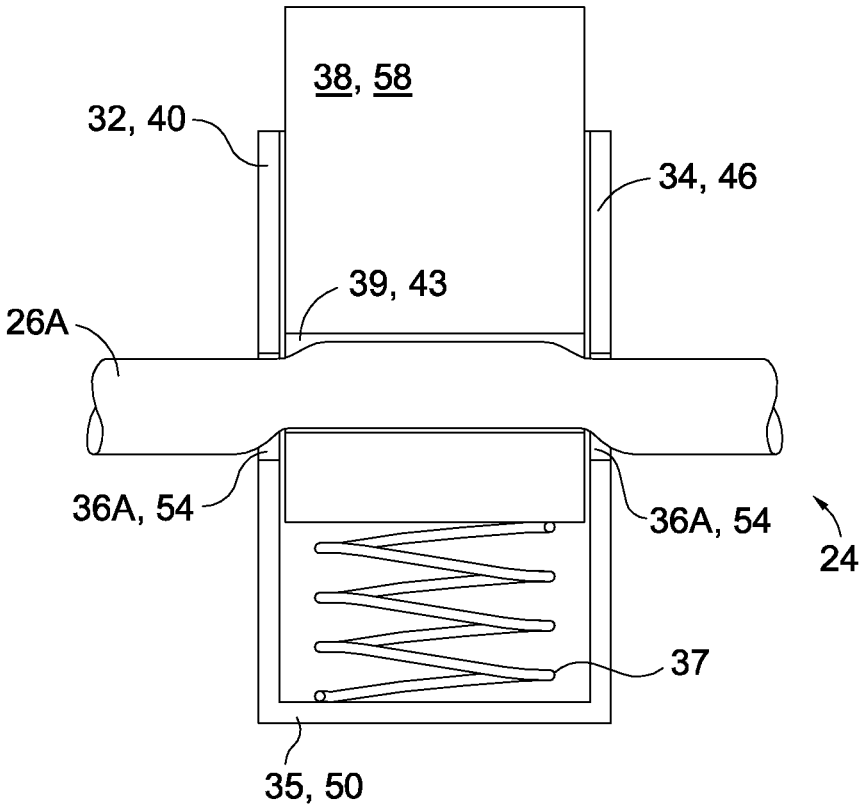
FIG. 5 is a representative cross section of the first cord lock or one lobe of the second cord lock in a released position, showing the internal locking components in accordance with the invention.

Turning now to FIGS. 4 and 5, shown is a detailed view of closure mechanism 14. As can be seen, closure mechanism 14 is generally comprised of first cord lock 28 and second cord lock 30. First cord lock 28 includes cord lock housing 32 having side wall 34 and a bottom 35 forming a recess therein. Housing 32 includes a first pair of holes 36A and a second pair of holes 36B formed on side wall 34. First pair of holes 36A are diametrically opposed from one another and are adapted to receive first end 26A of drawstring 24. Second pair of holes 36B are diametrically opposed from one another and are adapted to receive second end 26B of drawstring 24. Plunger member 38 is slidably disposed within the cord lock housing 32 and has transversely disposed first and second through-holes 39 configured to align with respective first pair of holes 36A and second pair of holes 36B. A biasing member 37 is positioned between the bottom of cord lock housing 32 and plunger member 38.

When plunger member 38 is depressed biasing member 37 is compressed so that the first and second through-holes coaxially align with their respective first pair of holes 36A and second pair of holes 36B so as to allow drawstring 24 to slide within first cord lock 28. When plunger member 38 is released biasing member 37 expands so as to misalign the first and second through-holes with their respective first pair of holes 36A and second pair of holes 36B so as to lock drawstring 24 between plunger member 38 and cord lock housing 28.

With continued reference to FIGS. 4 and 5, second cord lock 30 includes cord lock housing 40 having first lobe 42 and second lobe 44. Each lobe 42/44 has a side wall 46/48 and a bottom 50/52 forming a recess therein. Each lobe 42/44 further includes a pair of diametrically opposed holes 54/56 formed on the side wall 46/48. Holes 54 of first lobe 42 are adapted to receive first end 26A of drawstring 24. Holes 56 of second lobe 44 are adapted to receive second end 26B of drawstring 24. Respective plunger members 58/60 are slidably disposed within each of lobes 42/44. Each plunger member 58/60 includes a transversely disposed through-hole 43 configured to align with its respective pair of holes 54/56. A biasing member 37 is positioned within each lobe 42/44 between bottom 50/52 of the lobe and its respective plunger member 58/60.

When the respective plunger member 58/60 is depressed, its respective biasing member is compressed so that the through-hole coaxially aligns with its respective pair of holes 54/56 so as to allow drawstring 24 to slide within its respective housing lobe 42/44. When the respective plunger member 58/60 is released, its respective biasing member expands so as to misalign the through-hole with its respective pair of holes 54/56 so as to lock drawstring 24 between the plunger member 58/60 and its respective housing lobe 42/44. Simultaneous actuation of the first and second lobes 42/44 enables second cord lock 30 to slidably engage drawstring 24.

In accordance with an aspect of the present invention, to increase the difficulty of actuating the second cord lock, first lobe 42 and second lobe 44 of second cord lock 30 are oriented opposite one another so that the respective plunger members 58/60 slide in opposing directions. In this manner, a greater degree of manual dexterity is required to simultaneously actuate both plunger members 58/60 to slide second cord lock 30 than when both plunger members 58/60 are actuated by depressing the individual plunger members in the same direction. First and second ends 26A/26B of drawstring 24 may include a respective knob 62A/62B wherein each knob is configured to be larger than a respective hole 54/56 on first and second lobes 42/44. Alternatively, first and second ends 26A/26B may be tied in a knot such that the knot is too large to be withdrawn through holes 54/56.

In accordance with a further aspect of the present invention, a method of childproofing a package is provided. The method comprises the steps of: a) pulling a drawstring so as to selectively close the mouth of the package by actuating a first cord lock to slidably translate the first cord lock on the drawstring until the first cord lock is immediately adjacent the package thereby securing the mouth in a substantially occluded position; and b) simultaneously actuating first and second lobes of a second cord lock to slidably translate the second cord lock on the drawstring until the second cord lock is immediately adjacent the first cord lock. The mouth can then be selectively opened only after: i) simultaneously actuating the first and second lobes of the second cord lock so as to slidably translate the second cord lock away from the first cord lock and ii) actuating the first cord lock to translate the first cord lock toward the second cord lock. As an alternate method, the drawstrings may be drawn separately to selectively close the mouth of the package, followed by actuating the first cord lock to slidably translate the first cord lock on the drawstring until the first cord lock is immediately adjacent the package, then simultaneously actuating the first and second lobes of the second cord lock to slidably translate the second cord lock on the drawstring until the second cord lock is immediately adjacent the first cord lock.

In the embodiment describe herein, first cord lock 28 is positioned adjacent the mouth of the package and second lock 30 is positioned adjacent the first cord lock opposite the mouth. In another aspect of the invention, second cord lock 30 may be positioned adjacent the mouth of the bag and first cord lock may be positioned adjacent the second cord lock opposite the mouth.

In the embodiment described herein, tandem second cord lock 30 having dual locking lobes is used in conjunction with first cord lock 28, as described. In another aspect of the invention, another first cord lock 28 may be used in place of the tandem second cord lock 30.

In the embodiment described herein, tandem second cord lock 30 having dual locking lobes is used in conjunction with first cord lock 28, as described. In another aspect of the invention, another tandem second cord lock 30 may be used in place of the first cord lock 28.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A child-resistant packaging comprising:

a) a packaging container having a mouth;

b) a drawstring positioned along the mouth for selectively securing the mouth of the packaging in a closed state, the drawstring including first and second portions that extend from the mouth, the first portion including a first end of the drawstring, and the second portion including a second end of the drawstring;

c) a first cord lock comprising a first cord lock housing and a first actuating assembly, wherein the first cord lock housing is configured to receive the first and second ends of the drawstring, and wherein the first actuating assembly is configured to lockingly engage the first and second portions of the drawstring with the first cord lock housing; and d) a second cord lock comprising a second cord lock housing, a second actuating assembly, and a third actuating assembly, wherein the second cord lock housing includes a first lobe and a second lobe, wherein the first lobe is configured to receive the first end of the drawstring, wherein the second lobe is configured to receive the second end of the drawstring, wherein the second actuating assembly is adapted to lockingly engage the first portion of the drawstring with the first lobe, and wherein the third actuating assembly is adapted to lockingly engage the second portion of the drawstring with the second lobe.

2. The child-resistant packaging as claimed in claim 1 wherein the first cord lock is positioned adjacent to the mouth of the packaging, and wherein the second cord lock is positioned adjacent the first cord lock opposite to the mouth of the packaging.

3. The child-resistant packaging as claimed in claim 1 wherein actuation of the first actuating assembly enables the first cord lock to slidably engage the drawstring to selectively secure the mouth of the container in the closed state.

4. The child-resistant packaging as claimed in claim 3 wherein the mouth is child-resistant locked after actuation of the second actuating assembly and the third actuating assembly to slidably translate the second cord lock immediately adjacent the first cord lock.

5. The child-resistant packaging as claimed in claim 4 wherein the mouth is selectively opened only after: i) actuation of the second actuating assembly and the third actuating assembly so as to slidably translate the second cord lock away from the first cord lock and ii) actuation of the first actuating assembly to translate the first cord lock toward the second cord lock.

6. The child-resistant packaging as claimed in claim 1 wherein:

i) the first cord lock housing comprises a side wall and a bottom forming a recess therein, the first cord lock housing having a first pair of holes and a second pair of holes formed in the side wall with the first pair of holes diametrically opposed from one another and the second pair of holes diametrically opposed from one another, the first pair of holes adapted to receive the first end of the drawstring and the second pair of holes adapted to receive the second end of the drawstring;

ii) the first actuating assembly comprises a first plunger member and a first biasing member, the first plunger member is slidably disposed within the first cord lock housing, the first plunger member having transversely disposed first and second through-holes configured to align with the first pair of holes and the second pair of holes in the first cord lock housing, respectively, and the first biasing member is positioned between the bottom of the first cord lock housing and the first plunger member, wherein, when the first plunger member is depressed the first biasing member is compressed so that the first and second through-holes in the first plunger member coaxially align with the first pair of holes and the second pair of holes in the first cord lock housing, respectively, so as to allow the drawstring to slide within the first cord lock, and when the first plunger member is released the first biasing member expands so as to misalign the first and second through-holes in the first plunger member with the first pair of holes and the second pair of holes in the first cord lock housing, respectively, so as to lock the drawstring between the first plunger member and the first cord lock housing;

iii) each of the first and second lobes include a side wall and a bottom forming a recess therein, each of the first and second lobes include a pair of diametrically opposed holes formed in the side wall, the pair of holes of the first lobe are adapted to receive the first end of the drawstring and the pair of holes of the second lobe are adapted to receive the second end of the drawstring;

iv) the second actuating assembly includes a second plunger member and a second biasing member, the second plunger is slidably disposed within the first lobe and includes a transversely disposed through-hole configured to align with the pair of holes in the first lobe, the second biasing member is positioned between the bottom of the first lobe and the second plunger member, wherein, when the second plunger member is depressed the second biasing member is compressed so that the through-hole in the second plunger coaxially aligns with the pair of holes in the first lobe so as to allow the drawstring to slide within the first lobe, and when the second plunger member is released the second biasing member expands so as to misalign the through-hole in the second plunger with the pair of holes in the first lobe so as to lock the drawstring between the second plunger member and the first lobe; and v) the third actuating assembly includes a third plunger member and a third biasing member, the third plunger is slidably disposed within the second lobe and includes a transversely disposed through-hole configured to align with the pair of holes in the second lobe, the third biasing member is positioned between the bottom of the second lobe and the third plunger member, wherein, when the third plunger member is depressed the third biasing member is compressed so that the through-hole in the third plunger coaxially aligns with the pair of holes in the second lobe so as to allow the drawstring to slide within the second lobe, and when the third plunger member is released the third biasing member expands so as to misalign the through-hole in the third plunger with the pair of holes in the second lobe so as to lock the drawstring between the third plunger member and the second lobe.

7. The child-resistant packaging as claimed in claim 1 wherein simultaneous actuation of the second actuating assembly and the third actuating assembly enables the second cord lock to slidably engage the drawstring.

8. The child-resistant packaging as claimed in claim 1 wherein the first and second ends of the drawstring further include a respective knob, and wherein each knob is configured to be larger than a respective hole defined in the first and second cord lock.

9. The child-resistant packaging as claimed in claim 1 wherein the first and second lobes each include a longitudinal axis, and wherein the respective longitudinal axes of the first and second lobes are in spaced parallel relation with one another.

10. The child-resistant packaging as claimed in claim 9 wherein the first and second lobes are oriented so that simultaneous actuation of the first and second actuators enables the respective plunger members to slide in the same direction.

11. The child-resistant packaging as claimed in claim 9 wherein the first and second lobes are oriented opposite one another so that simultaneous actuation of the first and second actuators enables the respective plunger members to slide in opposing directions.

12. The child-resistant packaging as claimed in claim 1 wherein:

i) the first cord lock housing comprises a side wall and a bottom forming a recess therein, the first cord lock housing having a first pair of holes and a second pair of holes formed on the side wall with the first pair of holes diametrically opposed from one another and the second pair of holes diametrically opposed from one another, the first pair of holes adapted to receive the first end of the drawstring and the second pair of holes adapted to receive the second end of the drawstring;

ii) the first actuating assembly comprises a plunger member and a biasing member, the plunger member is slidably disposed within the first cord lock housing, the plunger member having transversely disposed first and second through-holes configured to align with the first pair of holes and the second pair of holes in the first cord lock housing, respectively, and the biasing member is positioned between the bottom of the first cord lock housing and the plunger member, wherein, when the plunger member is depressed the biasing member is compressed so that the first and second through-holes coaxially align with the first pair of holes and the second pair of holes in the first cord lock housing, respectively, so as to allow the drawstring to slide within the first cord lock, and when the plunger member is released the biasing member expands so as to misalign the first and second through-holes with the first pair of holes and the second pair of holes in the first cord lock housing, respectively, so as to lock the drawstring between the plunger member and the first cord lock housing.

13. A method of affecting a child-resistant closure of a container, the container including a flexible mouth, a drawstring positioned along the flexible mouth for selectively securing the mouth in a closed state, the drawstring including first and second portions that extend from the mouth, the first portion including a first end of the drawstring, and the second portion including a second end of the drawstring, the method comprising:

a) providing a first cord lock comprising a first cord lock housing and a first actuating assembly, the first cord lock housing configured to receive the first and second ends of the drawstring, the first actuating assembly configured to lockingly engage the first and second portions of the drawstring;

b) providing a second cord lock positioned adjacent the first cord lock opposite to the mouth of the packaging, the second cord lock comprising a second cord lock housing, a second actuating assembly, and a third actuating assembly, the second cord lock housing including a first lobe and a second lobe, the first lobe configured to receive the first end of the drawstring, the second lobe configured to receive the second end of the drawstring, the second actuating assembly configured to lockingly engage the first portion of the drawstring with the first lobe, and the third actuating assembly configured to lockingly engage the second portion of the drawstring, c) pulling the drawstring so as to selectively close the mouth;

d) actuating the first actuating assembly to slidably translate the first cord lock on the drawstring until the first cord lock lockingly engages the first and second portions of the drawstring immediately adjacent the mouth of the package thereby securing the mouth in a substantially occluded position; and e) actuating the second and third actuating assemblies on the drawstring until the second cord lock lockingly engages the first and second portions of the drawstring immediately adjacent the first cord lock.

14. The method of claim 13 wherein the mouth is selectively opened only after: i) actuating the second and third actuating assemblies so as to slidably translate the second cord lock away from the first cord lock and ii) actuating the first actuating assembly to translate the first cord lock toward the second cord lock.

* * * * *